US006397867B2

(12) United States Patent
You

(10) Patent No.: US 6,397,867 B2
(45) Date of Patent: Jun. 4, 2002

(54) VENTED UMBRELLA

(76) Inventor: Ching-Chuan You, c/o Percy International Patent Corp. P.O. Box 1-79, Taipei (TW)

( * ) Notice: Subject to any disclaimer, the term of this patent is extended or adjusted under 35 U.S.C. 154(b) by 0 days.

(21) Appl. No.: 09/849,270

(22) Filed: May 7, 2001

Related U.S. Application Data

(63) Continuation-in-part of application No. 09/563,399, filed on May 3, 2000, now Pat. No. 6,250,319.

(51) Int. Cl.[7] ..... A45B 25/26; A45B 25/08
(52) U.S. Cl. ..... 135/33.7; 135/28; 135/39
(58) Field of Search ..... 135/33.7, 33.2, 135/28, 39, 41

(56) References Cited

U.S. PATENT DOCUMENTS 559,577 A * 5/1896 Hadfield
985,842 A * 3/1911 Roney
1,141,494 A * 6/1915 Schultz
1,429,828 A * 9/1922 Baker
2,143,978 A * 1/1939 Eeles
2,442,931 A * 6/1948 Morgan
2,474,516 A * 6/1949 Daniel
3,930,514 A * 1/1976 Wu
4,627,210 A * 12/1986 Beaulieu
5,085,239 A * 2/1992 Chin-Hung et al.
5,193,566 A * 3/1993 Chen
5,794,637 A * 8/1998 Figueroa
6,006,769 A * 12/1999 Lin
6,170,499 B1 * 1/2001 Lin
6,250,319 B1 * 6/2001 You ..... 135/33.7

* cited by examiner

*Primary Examiner*—Robert Canfield

(57) ABSTRACT

A vented umbrella is resistant to inversion from the wind and effective in ventilation. The umbrella comprises a foldable frame, a lower canopy, and an upper canopy in a concentric covering relation with respect to lower canopy with a small overlapped peripheral area therebetween. A plurality of nonelastic ropes are provided each connected between the center portion of peripheral edge in respective sector of lower canopy and the upper ring. Hence, a plurality of openings are formed at the junction between sectors of upper and lower canopies in a fully extended condition. This also can save cloth and effect a simplified manufacturing process.

3 Claims, 10 Drawing Sheets

VENTED UMBRELLA

This is a continuation-in-part of U.S. patent application Ser. No. 09/563,399, filed on May 3, 2000 in the name of Ching-Chuan YOU entitled "Vented Umbrella", which is now U.S. Pat. No. 6,250,319.

BACKGROUND OF THE INVENTION

1. Field of the Invention

The present invention relates to umbrellas and more particularly to a vented umbrella that is resistant to inversion from the wind and effective in ventilating air between the underside of umbrella and the upper side thereof.

2. Description of Related Art

Conventionally, an umbrella is a foldable means carried by people for protection against the rain and/or sun. Further, canopy is typically an opaque cloth with a close texture. This also means that the permeability thereof is poor. Hence, an umbrella user often feels muggy under the hot sun due to the poor ventilation. To the worse, in a rainy windy day, a wind will catch an umbrella user unaware and exert a force against the inner surface of the canopy which will cause the canopy to invert from its normal operable position to a bowed position.

A conventional windproof umbrella is shown in FIG. 8 wherein umbrella 3 comprises a lower canopy 30 and an upper canopy 31. Lower canopy 30 is in a covering position over the fully stretched ribs 41. A plurality of openings 301 are formed on lower canopy 30 wherein each opening 301 is located between two adjacent ribs 41. Upper canopy 31 is smaller than lower canopy 30 in size. Upper canopy 31 is in a concentric covering relation with respect to lower canopy 30 wherein openings 301 are also covered by upper canopy 31. With this, during windy weather, wind caught beneath the upper canopy 31 exits through the openings 301 and applies pressure to the underside of the lower canopy 30. This forces lower canopy 30 lift away from upper canopy 31 to provide a path for wind to escape the umbrella 3.

Another conventional windproof umbrella is shown in FIG. 9 wherein umbrella 5 comprises a lower canopy 50 and an upper canopy 51. Lower canopy 50 is in a covering position over the fully stretched ribs 61. A multilateral canopy 501 is in a concentric covering relation with respect to lower canopy 50. This umbrella 5 also can ventilate air through canopy 501.

But these are unsatisfactory for the purpose for which the invention is concerned for the following reasons:

1. Ventilation is poor. In detail, upper canopy is in a close covering relation with respect to lower canopy, whereby only a small vent exists between upper canopy and lower canopy for ventilating when a strong wind applies pressure to the underside of lower canopy.

2. Expensive. It is seen that lower canopy and upper canopy are relatively large. Further, the covering area of upper canopy with respect to lower canopy is also large, resulting in an increase in the manufacturing cost.

3. Complex manufacturing processes. The provision of openings inevitably complicates the manufacturing processes.

A still another conventional windproof umbrella is shown in FIGS. 10 and 11. This one eliminates the drawbacks of above two prior art umbrellas. In detail, peripheral edge 211 of upper canopy 21 is held taut by attaching elastic strips 22 to the fasteners 121 on stretchers 12 to form a plurality of V-shapes. This can prevent elastic strips 22 from sliding along the stretchers 12 as shown in FIG. 11. A plurality of large openings 204 are formed in the umbrella. However, elastic strips 22 generally have the same orientation as ribs 11, i.e., nearly parallel each other. Also, peripheral edge 211 of upper canopy 21 is partially closed by the open openings 204. To the worse, openings 204 may be closed by a strong wind coming from above the top of umbrella as indicated by arrow A. Thus the ventilation is poor. Further, the elasticity of elastic strips 22 will be worn out as time passes because the elastic strips 22 are often stretched. This in turn causes openings 204 to shrink. Furthermore, the provision of fasteners 121 is time consuming in assembly, resulting in an increase in the manufacturing cost.

SUMMARY OF THE INVENTION

It is an object of the present invention to provide a vented umbrella having the features of resistant to inversion from the wind, effective in ventilating air between the underside of umbrella and the upper side thereof, fabric saving, and simplified manufacturing process.

To achieve the above and other objects, the present invention provides a vented umbrella comprising a frame and a canopy covered on the stretched frame wherein the frame includes a shank, a hub, an upper ring, and a lower ring all provided on the shank, a plurality of ribs, and a plurality of stretchers being foldable. Canopy includes a lower canopy and an upper canopy in a concentric partial covering relation with respect to lower canopy with a small overlapped peripheral area therebetween. The peripheral edge of upper canopy is covered on the upper peripheral edge of lower canopy. A plurality of nonelastic ropes are provided each connected between the center portion of peripheral edge in each sectors of lower canopy and the upper ring. As such, an opening is formed at the junction between each sector of upper canopy and the corresponding sector of lower canopy when the umbrella is fully extended. Thus an effective ventilation in the umbrella is achieved.

The above and other objects, features and advantages of the present invention will become apparent from the following detailed description taken with the accompanying drawings.

DETAILED DESCRIPTION OF THE PREFERRED EMBODIMENTS

Figure 1:
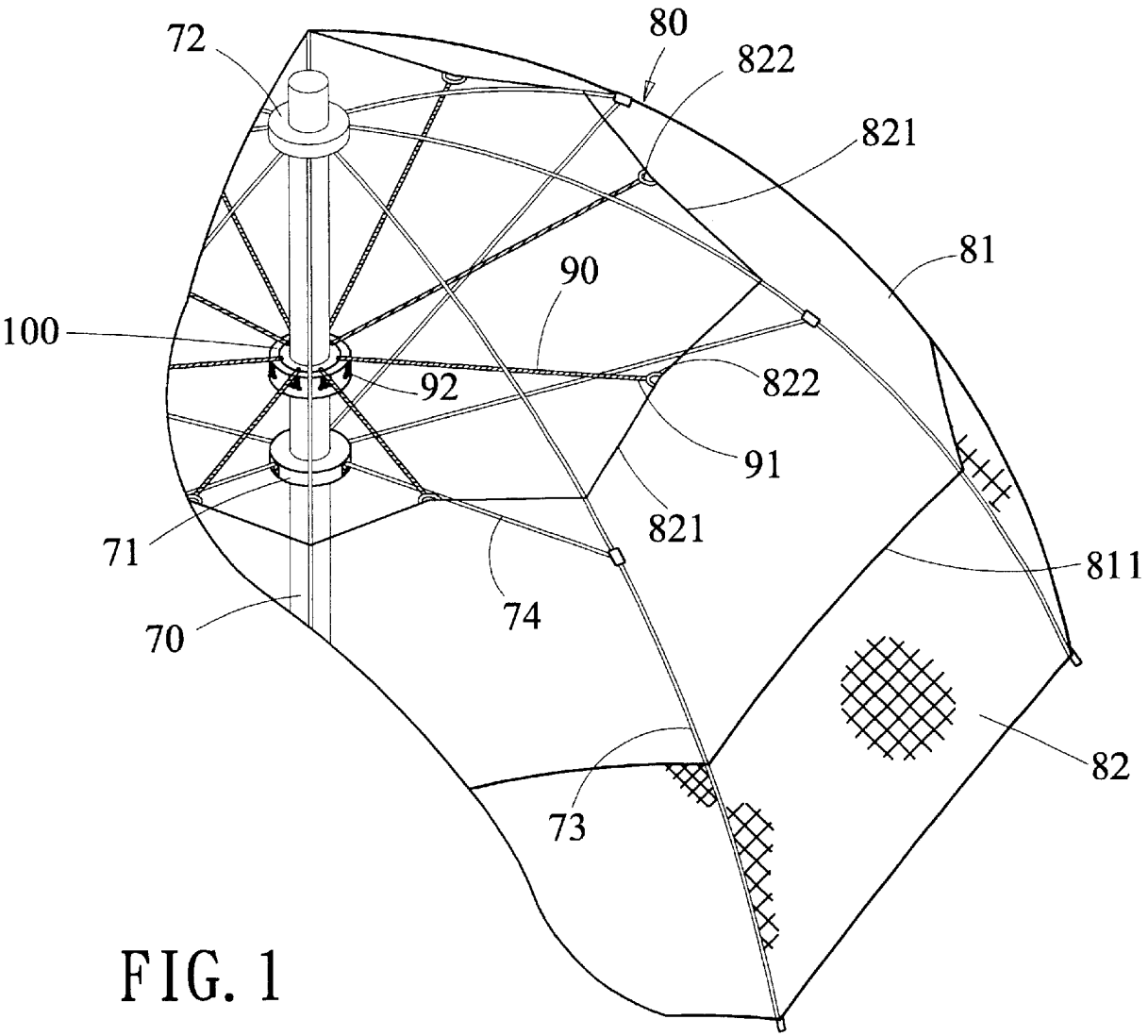
FIG. 1 is a partial perspective view of a first preferred embodiment of vented umbrella according to the invention, viewed from above the umbrella.
Figure 2A:
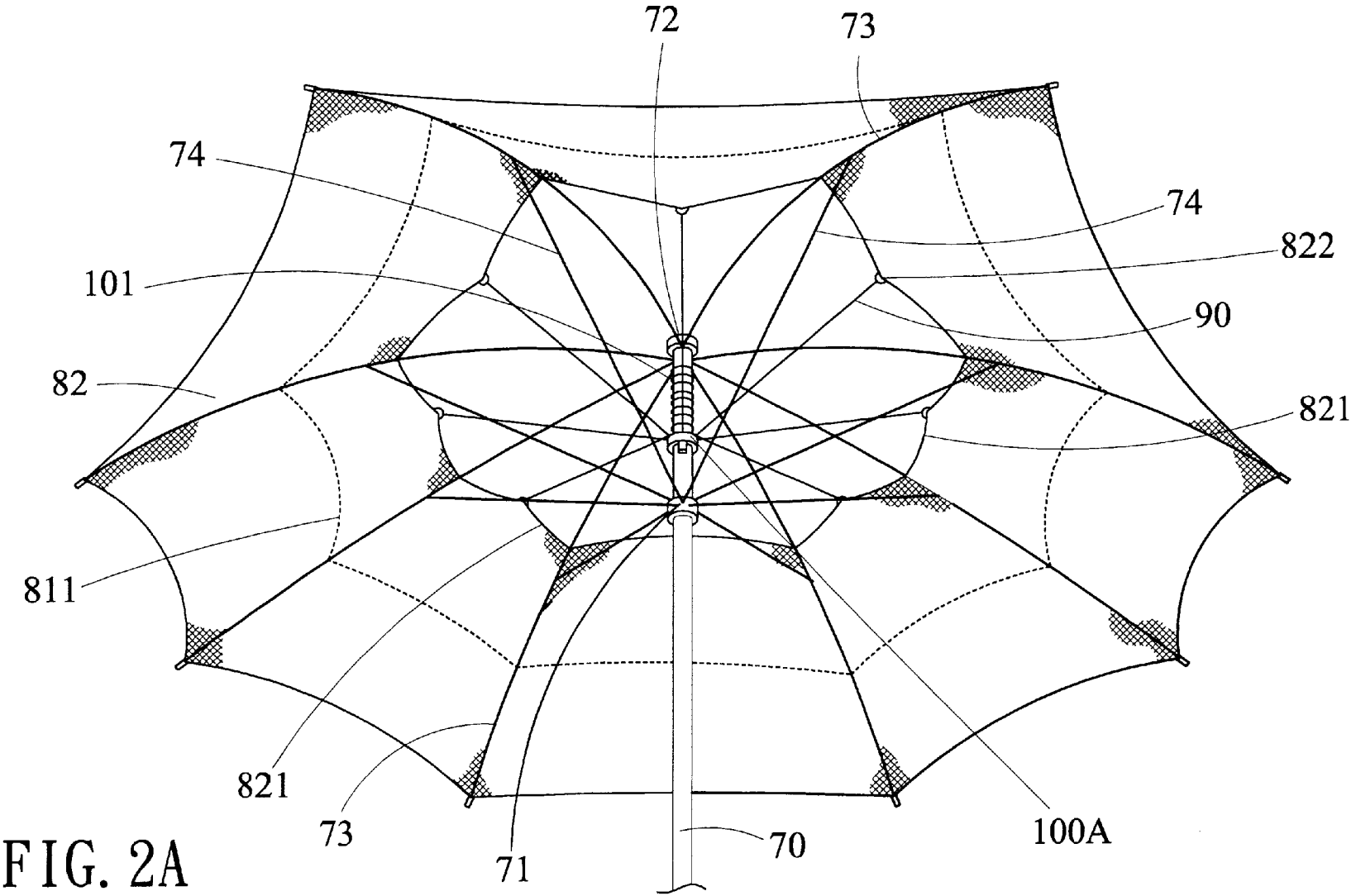
FIG. 2A is a perspective view of a second preferred embodiment of vented umbrella according to the invention, viewed from below the umbrella.
Figure 2B:
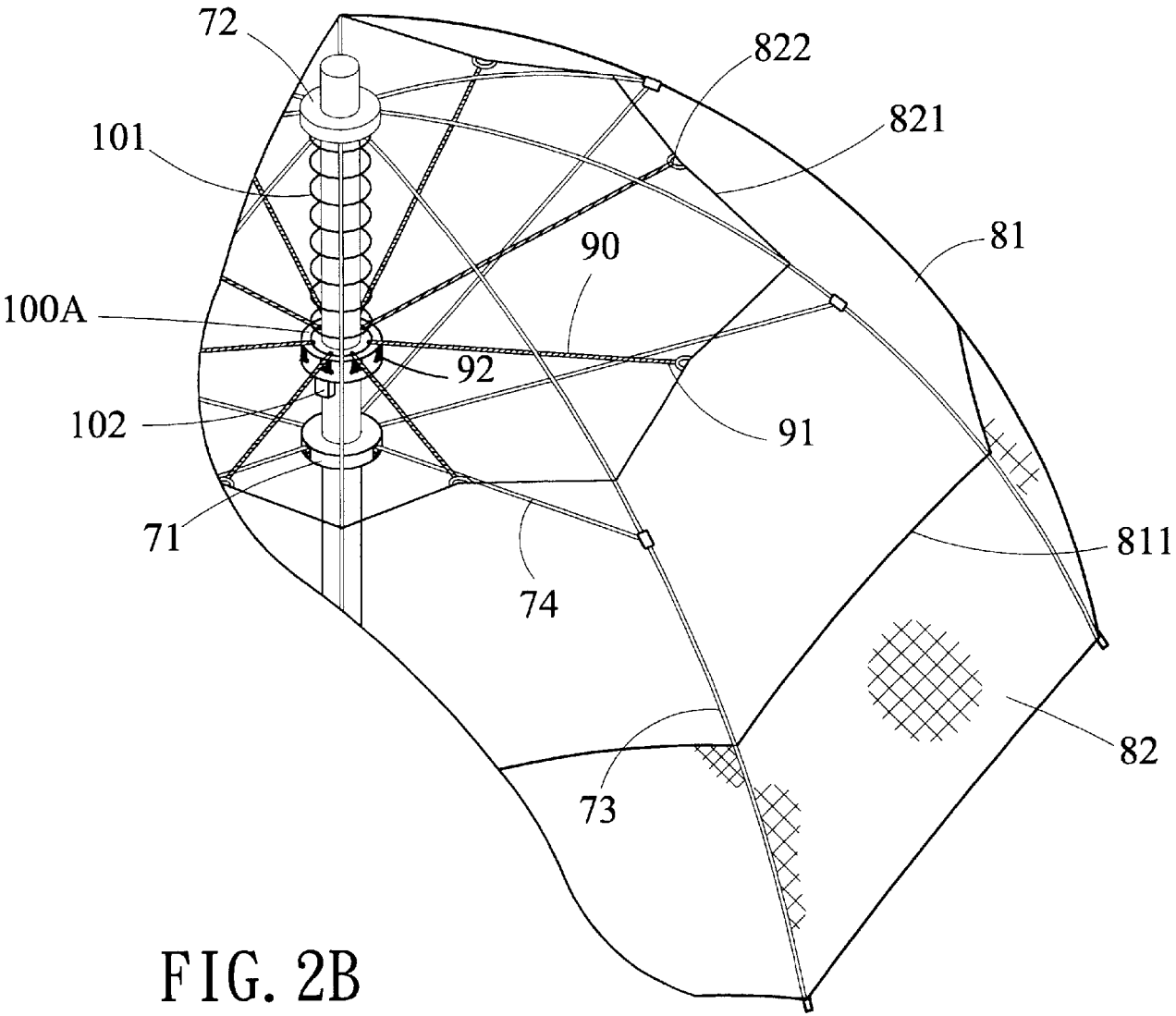
FIG. 2B is another partial perspective view of FIG. 2A, viewed from above the umbrella.
Figure 2C:
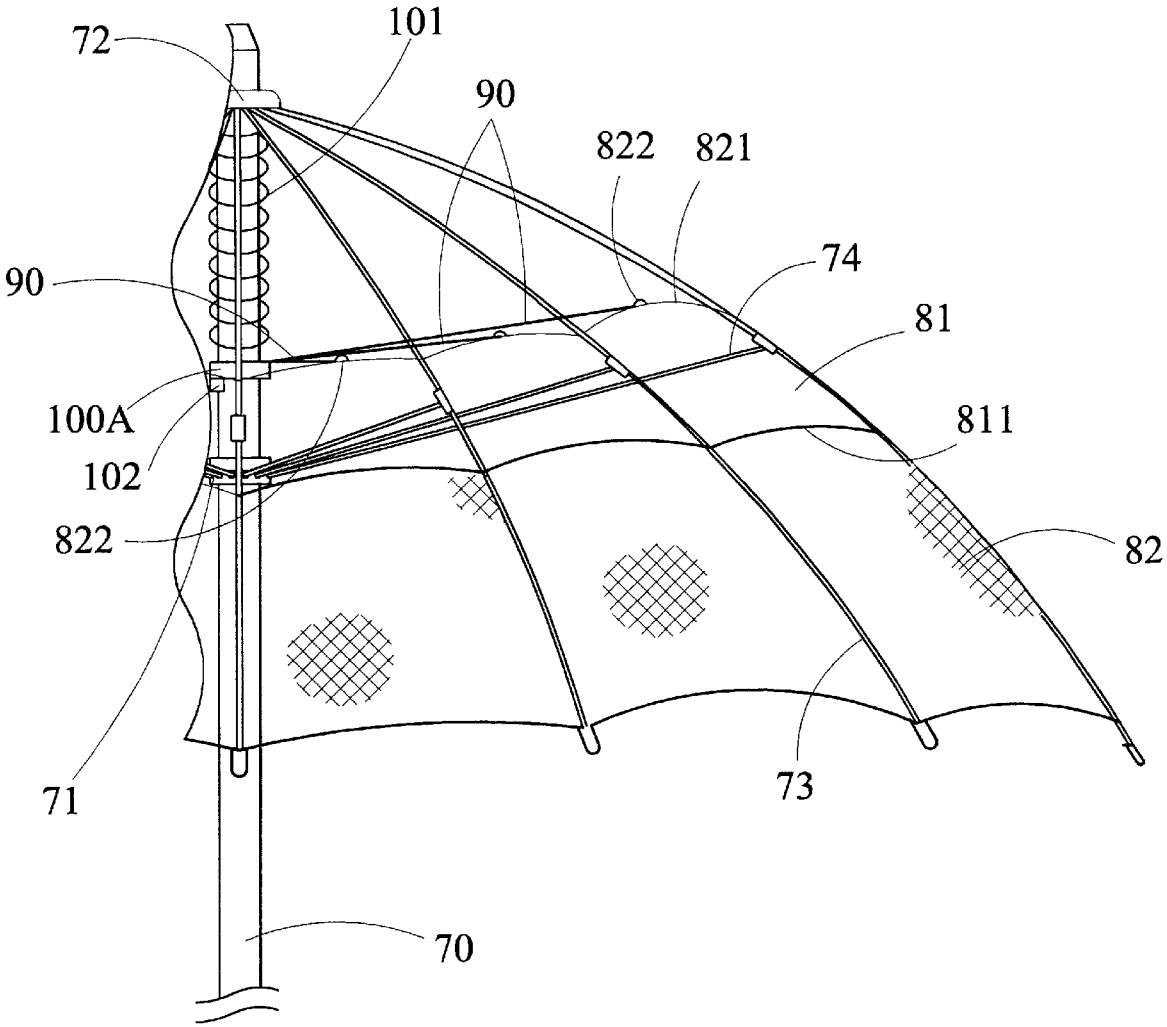
FIG. 2C is partial perspective view of FIG. 2C, viewed from the side.
Figure 2D:
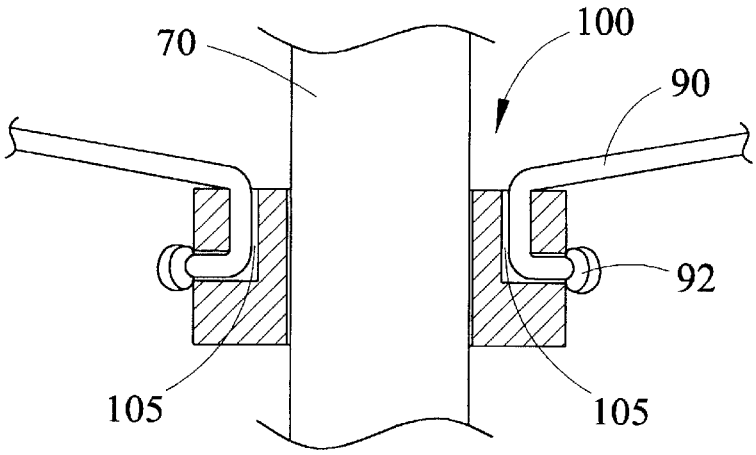
FIG. 2D is a sectional view of upper ring and associated components of FIG. 2A.
Figure 3:
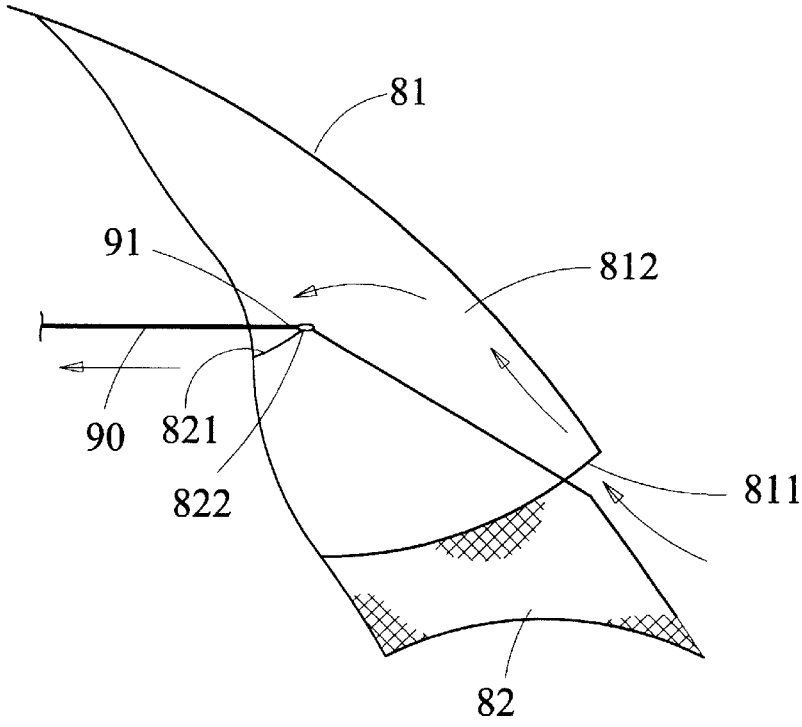
FIG. 3 is a side view illustrating the wind flow in the umbrella of the invention.
Figure 4:
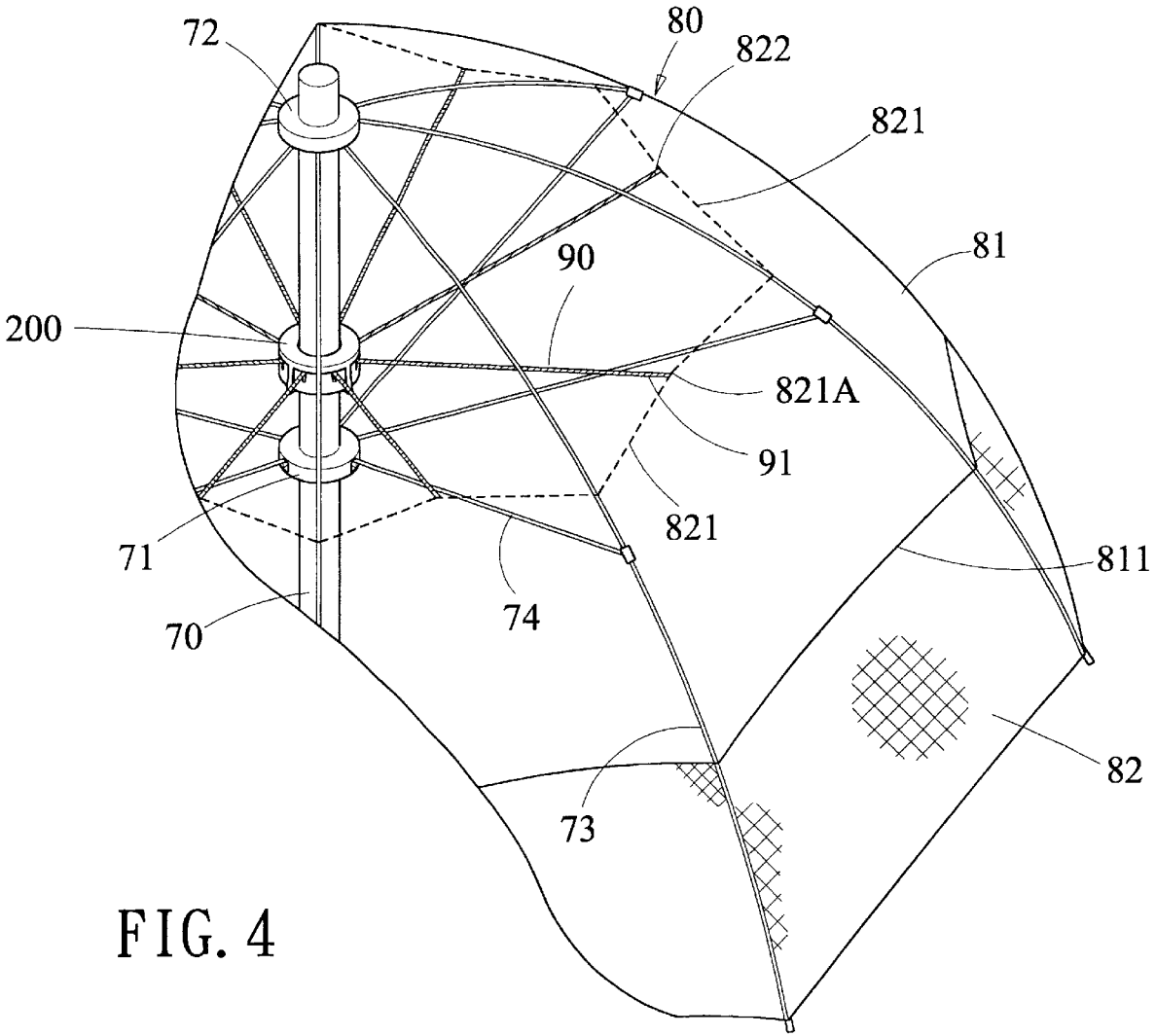
FIG. 4 is a partial perspective view of a third preferred embodiment of vented umbrella according to the invention, viewed from above the umbrella.
Figure 5A:
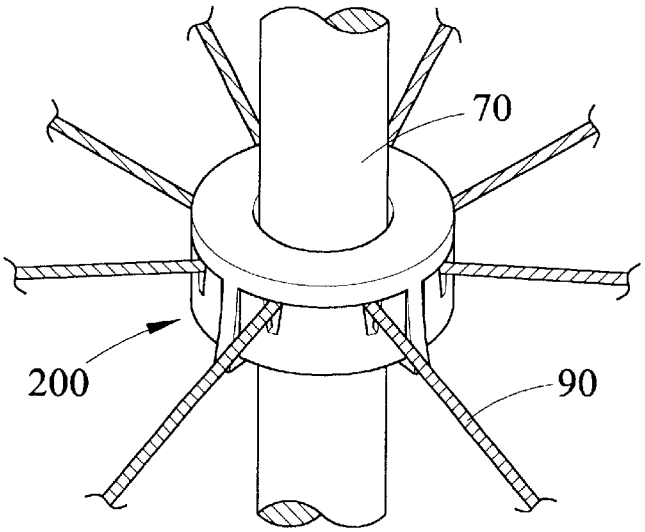
FIG. 5A is a fragmentary perspective view of upper ring and associated components shown in FIG. 4.
Figure 5B:
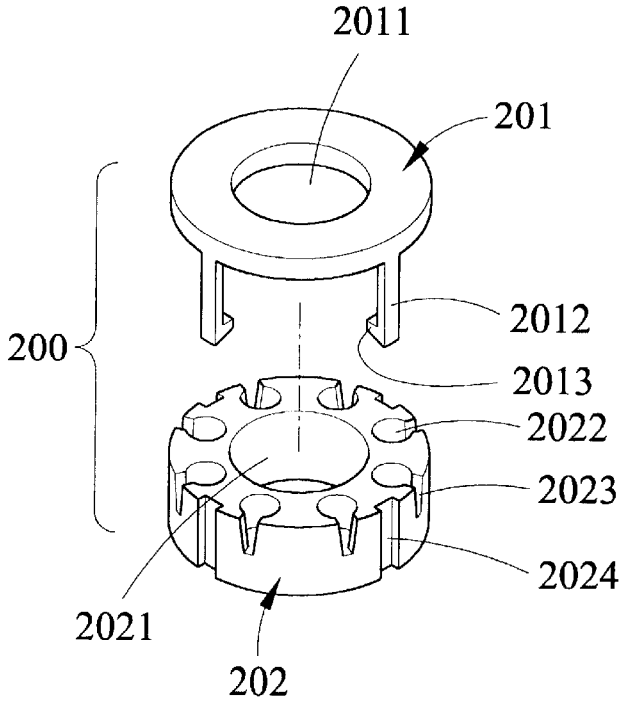
FIG. 5B is an exploded perspective view of upper ring shown in FIG. 5A.
Figure 6:
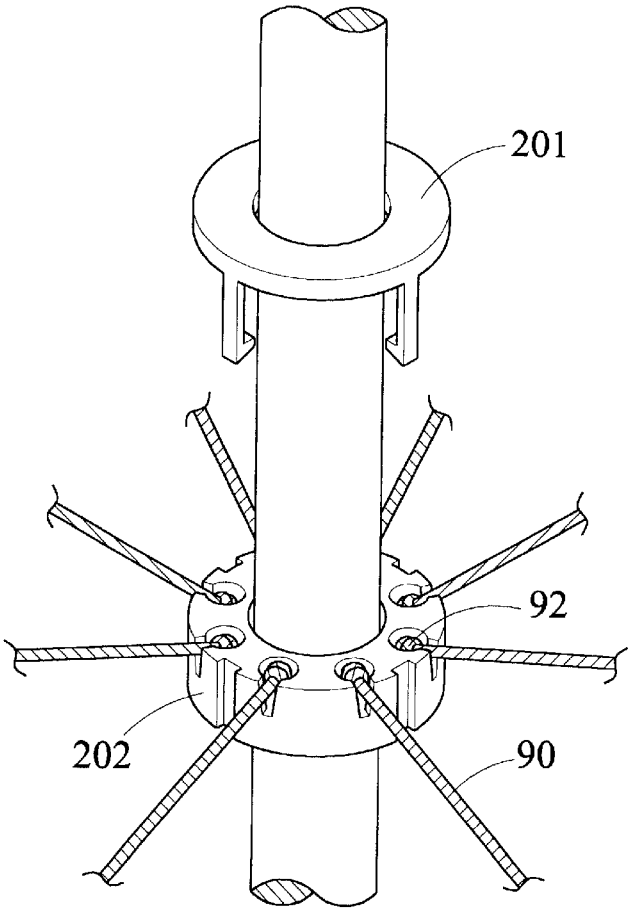
FIG. 6 is an exploded perspective view of FIG. 5A.
Figure 7:
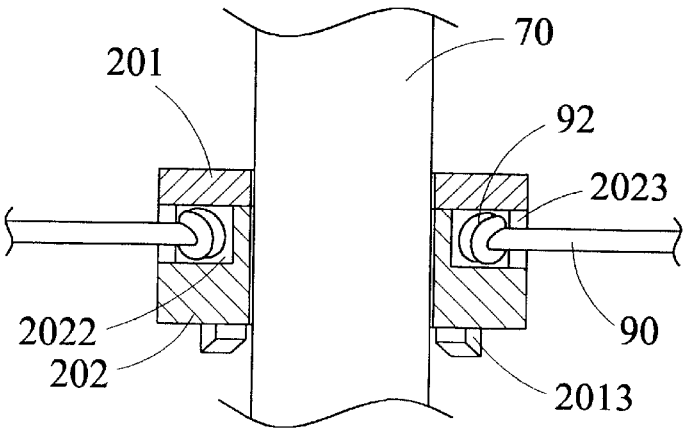
FIG. 7 is a sectional view of upper ring of FIG. 5A.
Figure 8:
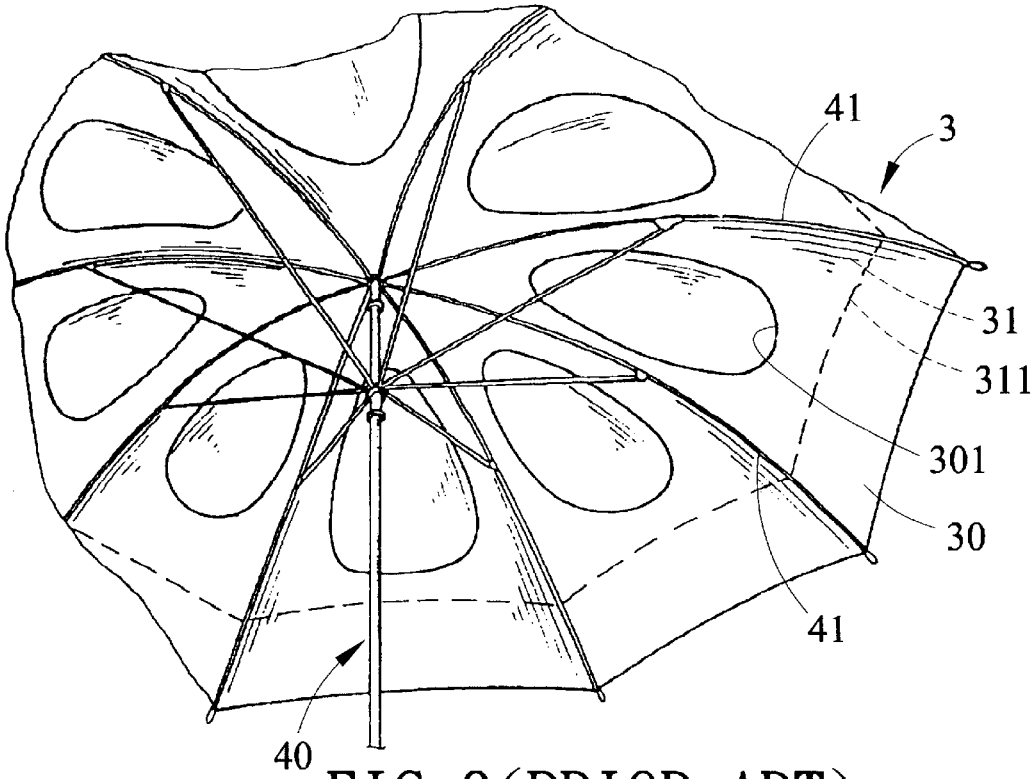
FIG. 8(PRIOR ART)
FIG. 8 is a perspective view of a first conventional windproof umbrella, viewed from below the umbrella.
Figure 9:
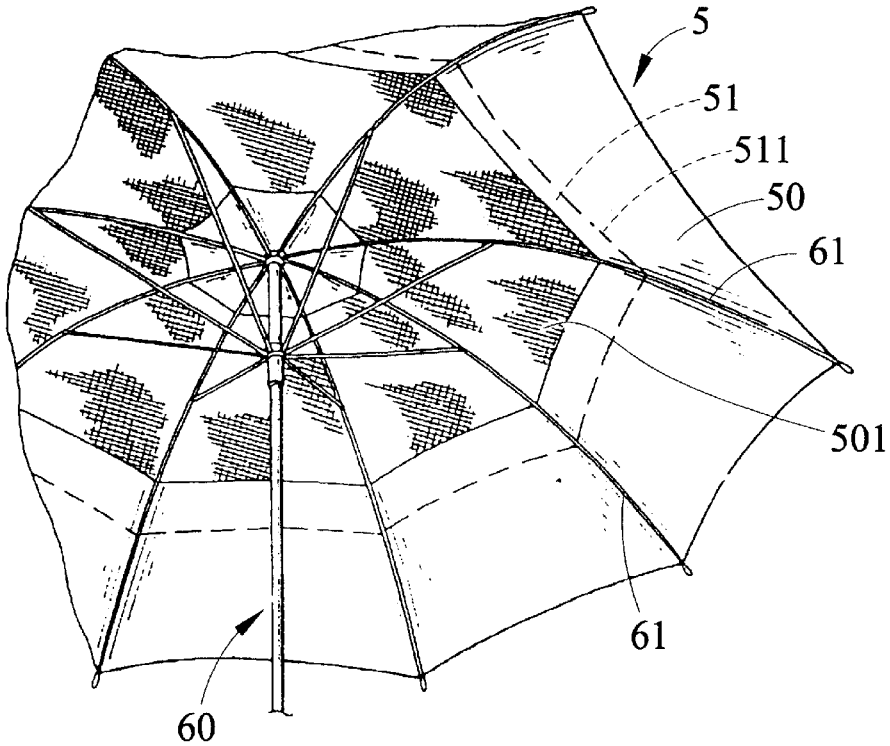
FIG. 9(PRIOR ART)
FIG. 9 is a perspective view of a second conventional windproof umbrella, viewed from below the umbrella.
Figures 10, 11:
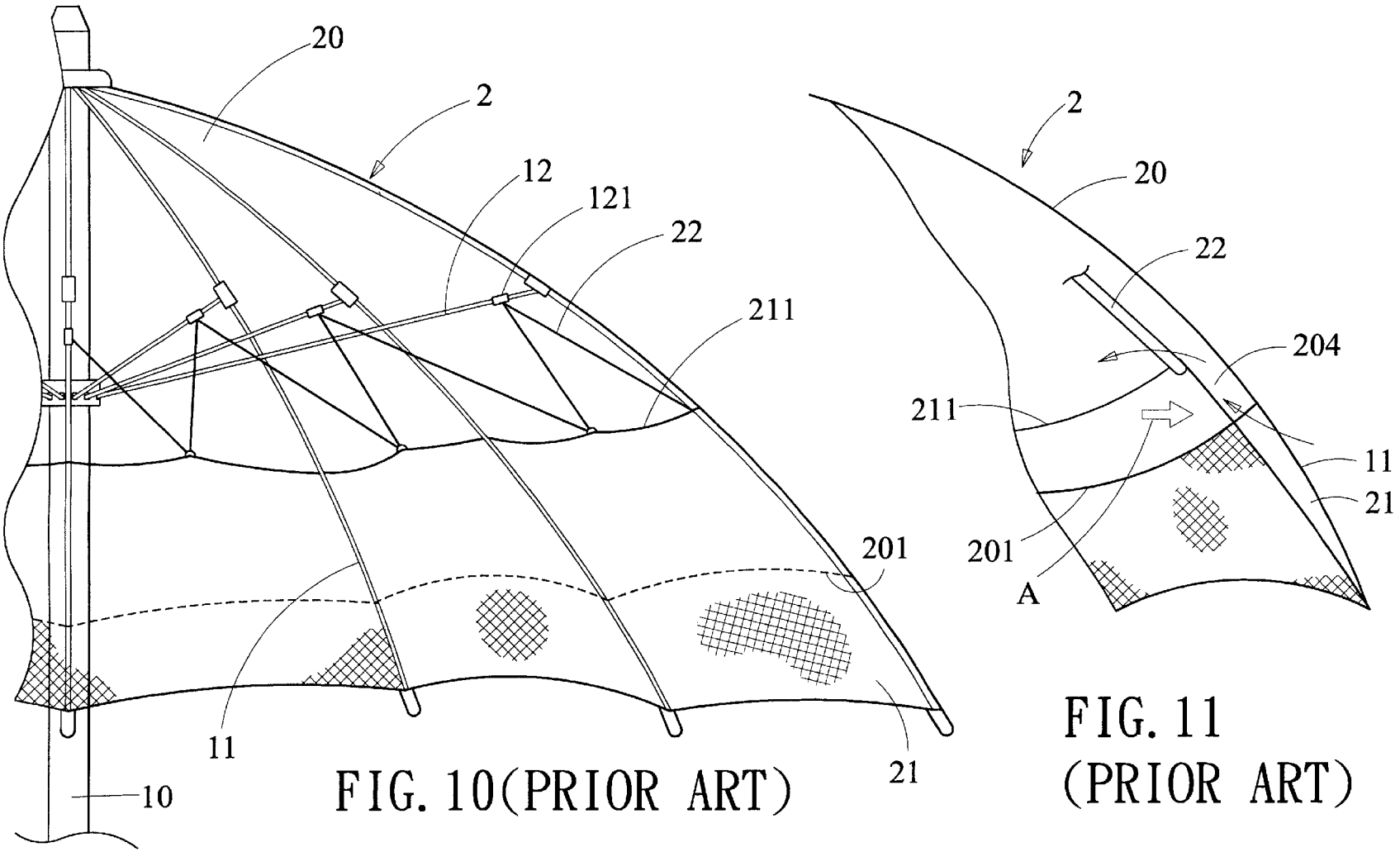
FIG. 11 (PRIOR ART)
FIG. 10(PRIOR ART)
FIG. 10 is a perspective view of a third conventional windproof umbrella, viewed from the side of umbrella.
FIG. 11 is a side view illustrating the wind flow in the windproof umbrella of FIG. 10.

Referring to the drawings and particularly to FIGS. 1 to 3, there is shown first and second preferred embodiments of vented umbrella in accordance with the invention. The frame of umbrella comprises a shank 70, a lower ring 71 and a hub 72 both provided around the shank 70, a plurality of ribs 73, and a plurality of stretchers 74 being foldable. Canopy 80 covered on the stretched frame includes a lower canopy 82 and an upper canopy 81. It is designed that the upper canopy 81 occupies about 60% to 80% of the total area of umbrella 80. The upper peripheral edge 821 of lower canopy 82 is extended from a position above the lower peripheral edge 811 of upper canopy 81. Hence, upper canopy 81 is in a concentric partial covering relation with respect to the lower canopy 82 with a small peripheral area being overlapped between lower and upper canopies 82 and 81.

In addition, a plurality of equally spaced apart L-shaped channels 105 extended from top surface to peripheral surface are formed on upper ring 100 affixed to the shank 70 (FIG. 2D). A plurality of generally horizontally extending ropes 90 are provided each having one end 91 stitched or fastened to the center portion of upper peripheral edge 821 in each sector of lower canopy 82 and the other end 92 inserted through a corresponding channel 105 and knotted on the peripheral opening thereof. With these approximately horizontally supporting forces of ropes 90, a plurality of large openings 812 are formed at the overlapped areas between the lower peripheral edge 811 of upper canopy 81 and the upper peripheral edge 821 of lower canopy 82 when umbrella is fully extended (FIG. 3). It is seen that rope 90 is preferably kept at the approximately horizontal orientation with respect to the shank 70 even at the strong wind condition and thus, as stated above, the plurality of openings 812 are generated for allowing wind to easily pass through. Further, the orientation of rope 90 according to the present invention is preferably at an angle of about 45 degrees with respect to the rib 73, or at an angle of about 90 degrees with respect to the shank 70, when upper canopy 81 is stretched outward to the full. Accordingly, the openings 812 can also be expanded to the full, resulting in a better ventilation.

FIGS. 2A to 2D illustrate the second preferred embodiment of vented umbrella according to the invention. This embodiment is generally the same as the first one except the provision of above channels 105 and the followings. Upper ring 100 of the first embodiment is replaced by a sliding upper ring 100A. Further, a coil spring 101 is biased between upper ring 100A and hub 72. Furthermore, a tab 102 is provided on shank 70 between upper ring 100A and lower ring 71 for defining the lowest position of upper ring 100A. With this configuration, the tautness of rope 90 is adapted to the strength of wind. Also, the size of opening 812 is adapted to the strength of wind.

FIGS. 4 to 7 illustrate a third preferred embodiment of vented umbrella according to the invention. This embodiment is generally the same as the first one except the followings. The integral upper ring 100 of the first embodiment is replaced by a two-piece upper ring 200. As shown, the two-piece upper ring 200 comprises a lower body 202 having a central bore 2021 sleeved on shank 70, a plurality of peripheral, equally spaced apart top openings 2022 each having a slit 2023 open to the periphery, and a plurality of equally spaced apart longitudinal grooves 2024 formed on the peripheral surface; and a cap 201 including a central hole 2011 substantially sized to conform to the bore 2021 and a plurality of legs 2012 each having a latch 2013.

In assembly, one end 91 of each rope 90 is first stitched or fastened to the center portion 821A of upper peripheral edge 821 in each sector of lower canopy 82 and the other end 92 is passed through the slit 2023 and knotted on the associated opening 2022. Then cling cap 201 onto lower body 202 in which latches 2013 are fastened to the bottom of lower body 202 by inserting legs 2012 into grooves 2024. This completes the upper ring 200.

Note that in effect, the orientation of rope 90 may be at an angle other than 45 degrees with respect to rib 73 as implemented in above two embodiments. For example, when the other end (i.e., the second end) 92 of rope 90 is in a fixed point, while one end (i.e., the first end) 91 of rope 90 is varied, the orientation of rope 90 has an angle between −45° and +45° with respect to the horizontal direction of the shank 70 is also possible. In addition, the rope 90 is preferable a nonelastic rope to prevent the tension of the rope from loosening when the umbrella is used for a period of time. It is to be understood that an arrangement of said plurality of ropes 90 according to the present invention is preferably positioned on the upper space of the plurality of stretchers 74 in order to prevent from being interfered by both the stretchers 74 and the ropes 90 when the umbrella is in a closed condition.

While the invention herein disclosed has been described by means of specific embodiments, numerous modifications and variations could be made thereto by those skilled in the art without departing from the scope and spirit of the invention set forth in the claims.

What is claimed is:

1. A vented umbrella comprising:

a frame including a shank;

a hub fixedly mounted on top of said shank;

an upper ring slidably mounted on said shank and including a plurality of equally spaced apart L-shaped channels extended from a top surface to a peripheral surface;

a lower ring slidably mounted on said shank;

a plurality of ribs each having one end linked to said hub;

a plurality of stretchers each having one end pivotally linked to said lower ring and said other end pivotally linked to an intermediate portion of a corresponding one of said ribs;

a canopy covered on said stretched frame including a lower canopy and an upper canopy each consisting of a plurality of sectors wherein said upper canopy is in a concentric partial covering relation with respect to said lower canopy with a predetermined overlapped peripheral area therebetween and a peripheral edge of said upper canopy is covered on an upper peripheral edge of said lower canopy; and a plurality of ropes each secured between said upper peripheral edge in each respective sector of said lower canopy and the corresponding L-shaped channel of the upper ring;

whereby a plurality of openings are formed at said overlapped peripheral area between said sectors of said upper canopy and said corresponding sectors of said lower canopy in a fully extended condition.

2. A vented umbrella comprising:

a frame including a shank;

a hub fixedly mounted on top of said shank;

an upper ring slidably mounted on said shank and including a lower body having a central bore sleeved on said shank, a plurality of peripheral, equally spaced apart top openings each having a slit open to a periphery, and a plurality of equally spaced apart longitudinal grooves formed on said periphery, and a cap including a central hole sleeved on said shank and a plurality of legs each having a latch wherein said latches are fastened to bottom of said lower body and said legs are received in said grooves, thereby releasably securing said cap to said lower body;

a lower ring slidably mounted on said shank;

a plurality of ribs each having one end linked to said hub;

a plurality of stretchers each having one end pivotally linked to said lower ring and said other end pivotally linked to an intermediate portion of a corresponding one of said ribs;

a canopy covered on said stretched frame including a lower canopy and an upper canopy each consisting of a plurality of sectors wherein said upper canopy is in a concentric partial covering relation with respect to said lower canopy with a predetermined overlapped peripheral area therebetween and a peripheral edge of said upper canopy is covered on an upper peripheral edge of said lower canopy; and a plurality of ropes each having one end secured to said upper peripheral edge in each respective sector of said lower canopy and an other end thereof secured to the respective top opening of said upper ring;

whereby a plurality of openings are formed at said overlapped peripheral area between said sectors of said upper canopy and said corresponding sectors of said lower canopy in a fully extended condition.

3. The vented umbrella of claim 2, wherein said other end of said rope is passed through said corresponding slit and knotted on said top opening.

* * * * *